US009516922B1

(12) United States Patent
Eigenman

(10) Patent No.: US 9,516,922 B1
(45) Date of Patent: Dec. 13, 2016

(54) FABRIC GATHERING DEVICE

(71) Applicant: Shannon Eigenman, Hanford, CA (US)

(72) Inventor: Shannon Eigenman, Hanford, CA (US)

( * ) Notice: Subject to any disclaimer, the term of this patent is extended or adjusted under 35 U.S.C. 154(b) by 0 days.

(21) Appl. No.: 14/820,989

(22) Filed: Aug. 7, 2015

(51) Int. Cl.

| | |
|---|---|
| ***A44B 1/04*** | (2006.01) |
| ***A44B 1/14*** | (2006.01) |
| ***A44B 1/18*** | (2006.01) |
| ***A44B 1/26*** | (2006.01) |
| ***A44B 1/28*** | (2006.01) |

(52) U.S. Cl.
CPC . *A44B 1/28* (2013.01); *A44B 1/04* (2013.01); *A44B 1/14* (2013.01); *A44B 1/18* (2013.01)

(58) Field of Classification Search
CPC ..... A44B 1/04; A44B 1/14; A44B 1/18; A44B 1/28; Y10T 24/44017; Y10T 24/1365; Y10T 24/1394; Y10T 24/1391; Y10T 24/346; Y10T 24/3465; A41F 1/00; A41D 27/00; A41D 27/08; A41D 2300/30
See application file for complete search history.

(56) References Cited

U.S. PATENT DOCUMENTS

| | | | |
|---|---|---|---|
| 2,361,772 | A | 10/1944 | Kaplan |
| 4,912,944 | A | 4/1990 | Crosley et al. |
| 5,862,814 | A | 1/1999 | Janik et al. |

*Primary Examiner* — Robert J Sandy
(74) *Attorney, Agent, or Firm* — Crossley & Stevenson Intellectual Property Law

(57) ABSTRACT

A fabric gathering device including a clasp having a front half hingedly attached to a back half, a plurality of rounded ridges continuously disposed on a front surface of the back half of the clasp, an aperture disposed through the back half of the clasp, a pin disposed on a back surface of the front half of the clasp, and a pin cap removably disposed on an apex of the pin. The clasp has an open position and an alternate closed position. The pin is disposed through the aperture when the clasp is in the closed position. The pin is disposed outside of the aperture when the clasp is in the open position.

7 Claims, 4 Drawing Sheets

FABRIC GATHERING DEVICE

BACKGROUND OF THE INVENTION

Various types of clasps and pins are known in the prior art. However, what has been needed is a fabric gathering device including a front half hingedly attached to a back half, a plurality of rounded ridges continuously disposed on a front surface of the back half of the clasp, an aperture disposed through the back half of the clasp, a pin disposed on a back surface of the front half of the clasp, and a pin cap removably disposed on an apex of the pin. What has been further needed is for the clasp to have an open position and an alternate closed position. The pin is disposed through the aperture when the clasp is in the closed position. The pin is disposed outside of the aperture when the clasp is in the open position. Lastly, what has been needed is for the pin to removably secure a piece of fabric within the clasp. The fabric gathering device thus provides a user with an easy, efficient, and affordable way to quickly adjust the size and change the style of an article of clothing. With the plurality of interchangeable decorative covers, the device can further be personalized by the user depending on his individual preferences at the time of use. Although the fabric gathering device can be used with clothing, the user can also attach the device to household items that include, but are not limited to, curtains, tablecloths, towels, and furniture covers. The pin cap ensures both the safety of the user and the secure attachment of the fabric within the clasp.

FIELD OF THE INVENTION

The present invention relates to clasps and pins, and more particularly, to a fabric gathering device.

SUMMARY OF THE INVENTION

The general purpose of the present fabric gathering device, described subsequently in greater detail, is to provide a fabric gathering device which has many novel features that result in a fabric gathering device which is not anticipated, rendered obvious, suggested, or even implied by prior art, either alone or in combination thereof.

To accomplish this, the present fabric gathering device includes a clasp, a plurality of rounded ridges, an aperture, a pin, and a pin cap. The clasp has a front half hingedly attached to a back half. Each of the front half and the back half has a front surface, a back surface, a top edge, a bottom edge, a right edge, and a left edge. The clasp can optionally have a length within a range of one inch to ten inches, and a width within a range of one inch to ten inches. The plurality of ridges is continuously disposed on the front surface of the back half of the clasp from the top edge of the back half to the bottom edge of the back half. Each of the plurality of ridges extends toward the back surface of the front half of the clasp. The aperture is disposed through the back half of the clasp proximal the top edge from the back surface to the front surface.

The pin has an apex and a base surface. The base surface of the pin is disposed on the back surface of the front half of the clasp proximal the top edge. A circumference of the pin proximal the base surface of the pin substantially conforms to a circumference of the aperture. The clasp has an open position and an alternate closed position. The pin is disposed through the aperture and the front half of the clasp is parallel to the back half of the clasp when the clasp is in the closed position. The pin is disposed outside of the aperture when the clasp is in the open position. The pin cap is removably disposed on the apex of the pin. The pin is configured to removably secure a piece of fabric within the clasp.

The fabric gathering device optionally includes a pair of L-shaped slots and a plurality of interchangeable decorative covers. The pair of L-shaped slots includes a right slot and a left slot. The right slot is continuously disposed on the front surface of the front half of the clasp proximal the right edge of the front half from the top edge of the front half to proximal the bottom edge of the front half. The left slot is continuously disposed on the front surface of the front half of the clasp proximal the left edge of the front half from the top edge of the front half to proximal the bottom edge of the front half. Each of the plurality of interchangeable decorative covers has a right side and a left side. The right side and the left side of one of the plurality of decorative covers removably and slidably engages within the right slot and the left slot, respectively. A perimeter of each of the plurality of decorative covers substantially conforms to a perimeter of the front half of the clasp. The clasp and each of the plurality of decorative covers can optionally be substantially rectangular. The clasp and each of the plurality of decorative covers can optionally be metal and, alternately, plastic.

Thus has been broadly outlined the more important features of the present fabric gathering device so that the detailed description thereof that follows may be better understood and in order that the present contribution to the art may be better appreciated.

BRIEF DESCRIPTION OF THE DRAWINGS

FIGURES

Figure 1:
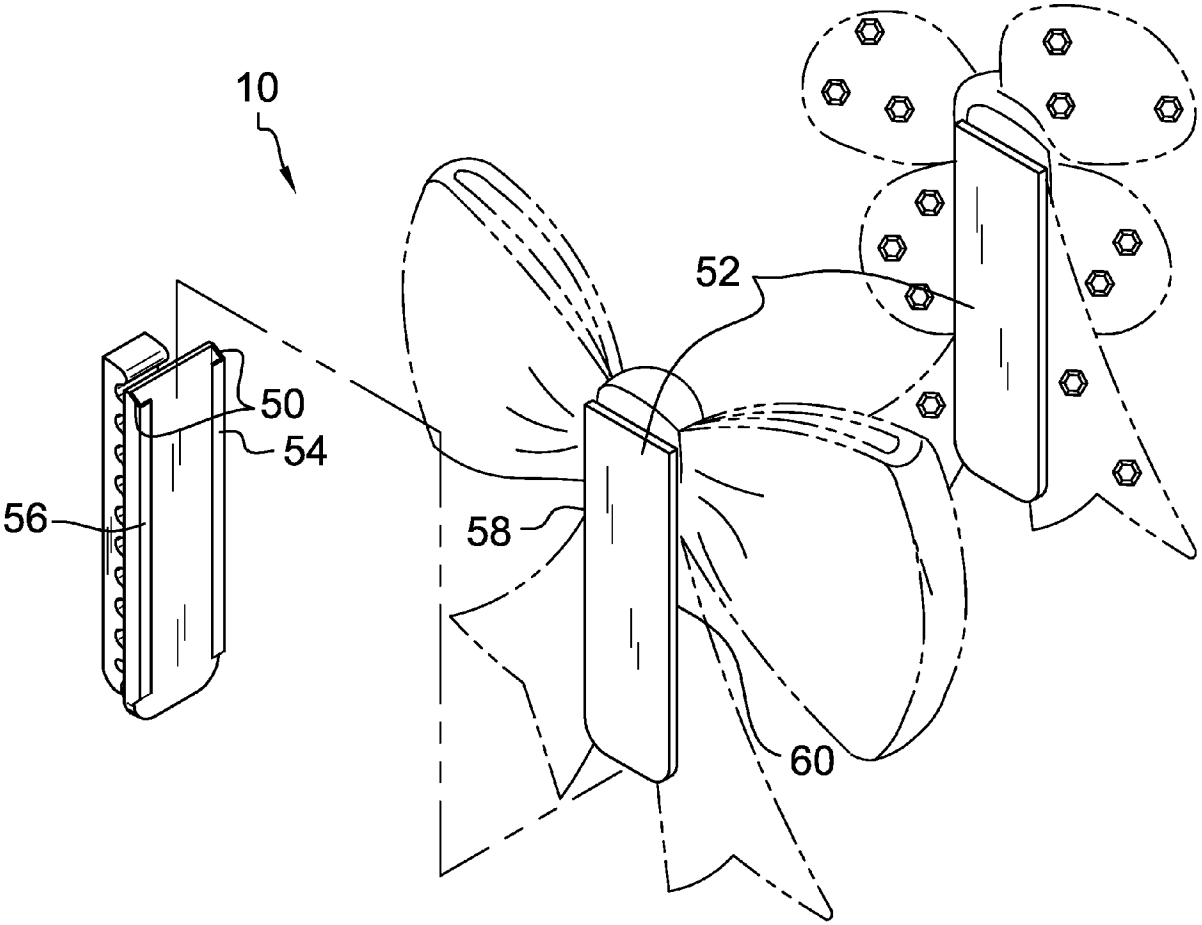

FIG. 1 is a front isometric view showing a decorative cover and a clasp.

Figure 2:
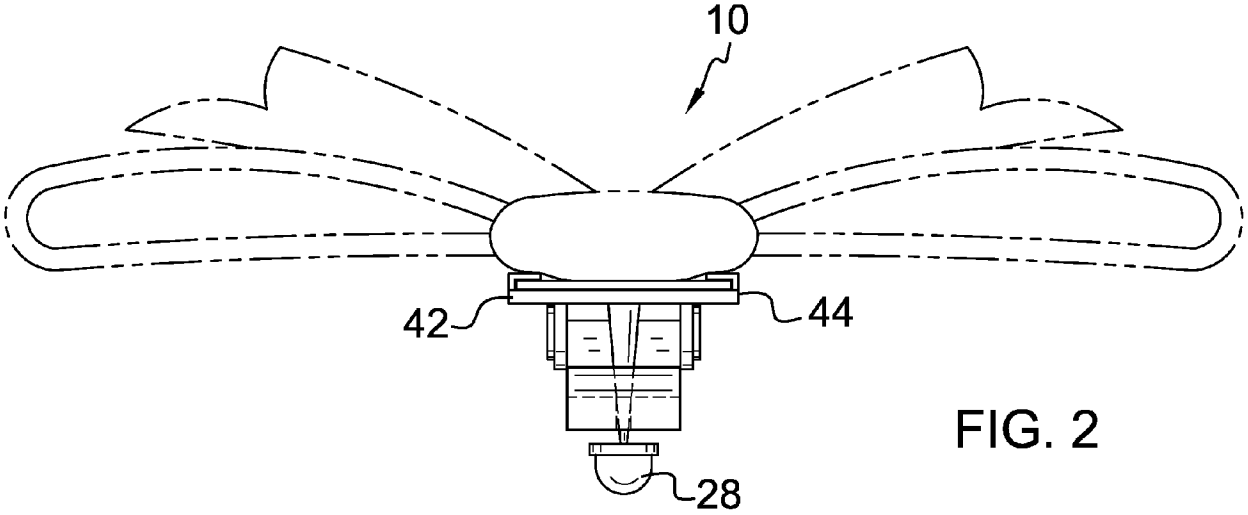

FIG. 2 is a top plan view showing the decorative cover engaged within a pair of slots.

Figure 3:
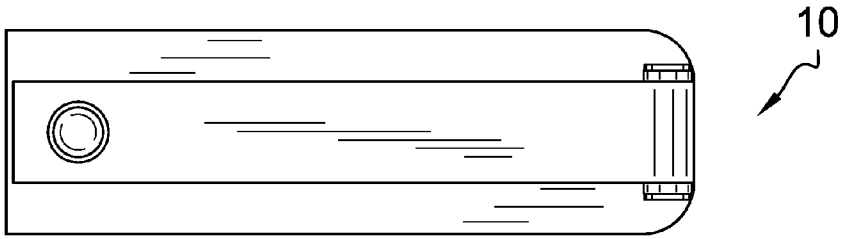

FIG. 3 is a rear elevation view.

Figure 4:
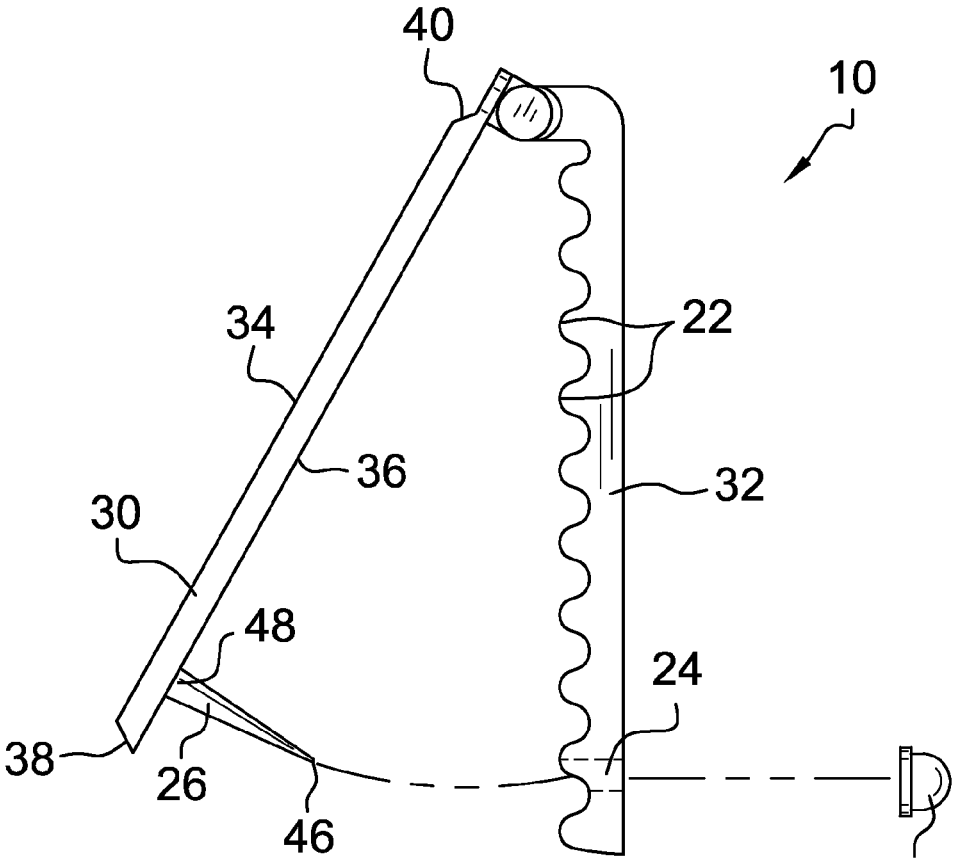

FIG. 4 is a side elevation view.

Figure 5:
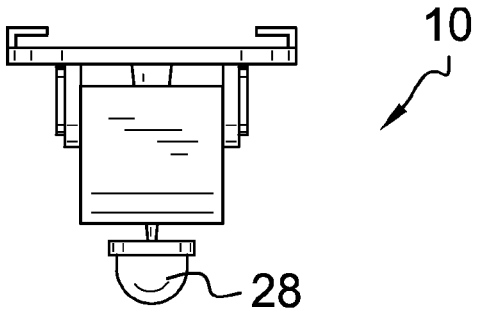

FIG. 5 is a bottom plan view.

Figure 6:
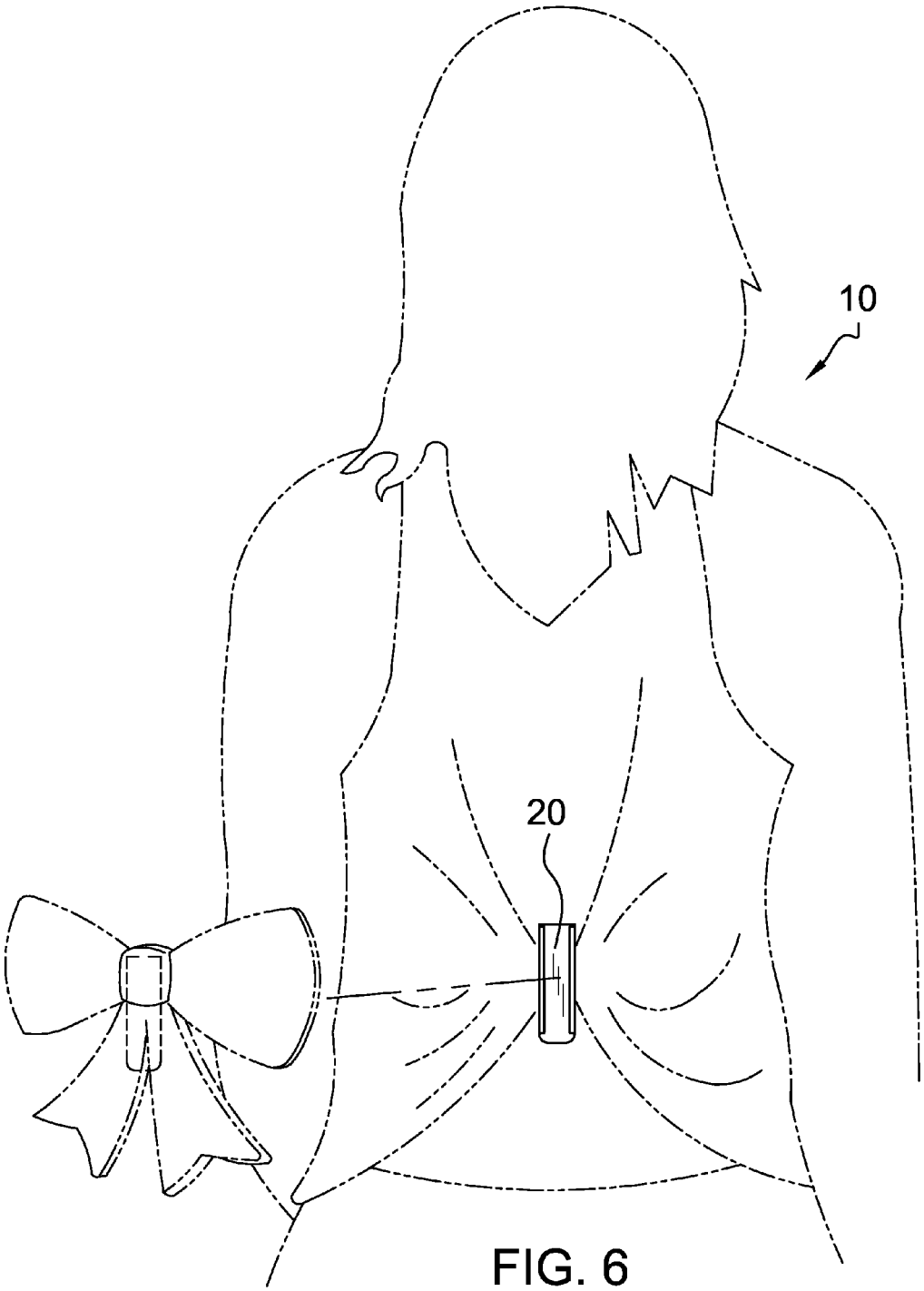

FIG. 6 is an in-use view.

DETAILED DESCRIPTION OF THE DRAWINGS

With reference now to the drawings, and in particular FIGS. 1 through 6 thereof, an example of the instant fabric gathering device employing the principles and concepts of the present fabric gathering device and generally designated by the reference number 10 will be described.

Referring to FIGS. 1 through 6 the present fabric gathering device 10 is illustrated. The fabric gathering device 10 includes a clasp 20, a plurality of rounded ridges 22, an aperture 24, a pin 26, and a pin cap 28. The clasp 20 has a front half 30 hingedly attached to a back half 32. Each of the front half 30 and the back half 32 has a front surface 34, a back surface 36, a top edge 38, a bottom edge 40, a right edge 42, and a left edge 44. The plurality of ridges 22 is continuously disposed on the front surface 34 of the back half 32 of the clasp 20 from the top edge 38 of the back half 32 to the bottom edge 40 of the back half 32. Each of the plurality of ridges 22 extends toward the back surface 36 of the front half 30 of the clasp 20. The aperture 24 is disposed through the back half 32 of the clasp 20 proximal the top edge 38 from the back surface 36 to the front surface 34.

The pin 26 has an apex 46 and a base surface 48. The base surface 48 of the pin 26 is disposed on the back surface 36 of the front half 30 of the clasp 20 proximal the top edge 38.

The clasp 20 has an open position and an alternate closed position. The pin 26 is disposed through the aperture 24 and the front half 30 of the clasp 20 is parallel to the back half 32 of the clasp 20 when the clasp 20 is in the closed position. The pin 26 is disposed outside of the aperture 24 when the clasp is in the open position. The pin cap 28 is removably disposed on the apex 46 of the pin 26.

The fabric gathering device 10 optionally includes a pair of L-shaped slots 50 and a plurality of interchangeable decorative covers 52. The pair of L-shaped slots 50 includes a right slot 54 and a left slot 56. The right slot 54 is continuously disposed on the front surface 34 of the front half 30 of the clasp 20 proximal the right edge 42 of the front half 30 from the top edge 38 of the front half 30 to proximal the bottom edge 40 of the front half 30. The left slot 56 is continuously disposed on the front surface 34 of the front half 30 of the clasp 20 proximal the left edge 44 of the front half 30 from the top edge 38 of the front half 30 to proximal the bottom edge 40 of the front half 30. Each of the plurality of interchangeable decorative covers 52 has a right side 58 and a left side 60. The right side 58 and the left side 60 of one of the plurality of decorative covers 52 removably and slidably engages within the right slot 54 and the left slot 56, respectively.

What is claimed is:

1. A fabric gathering device comprising:

a clasp having a front half hingedly attached to a back half, each of the front half and the back half having a front surface, a back surface, a top edge, a bottom edge, a right edge, and a left edge;

a plurality of rounded ridges continuously disposed on the front surface of the clasp back half from the back half top edge to the back half bottom edge, wherein each of the plurality of ridges extends toward the back surface of the clasp front half;

an aperture disposed through the clasp back half proximal the top edge from the back surface to the front surface;

a pin having an apex and a base surface, the pin base surface disposed on the back surface of the clasp front half proximal the top edge;

wherein a circumference of the pin proximal the pin base surface substantially conforms to a circumference of the aperture;

wherein the clasp has an open position and an alternate closed position;

wherein the pin is disposed through the aperture and the clasp front half is parallel to the clasp back half when the clasp is in the closed position;

wherein the pin is disposed outside of the aperture when the clasp is in the open position;

a pin cap removably disposed on the pin apex;

wherein the pin is configured to removably secure a piece of fabric within the clasp.

2. The fabric gathering device of claim 1 further comprising:

a pair of L-shaped slots comprising a right slot and a left slot, wherein the right slot is continuously disposed on the front surface of the clasp front half proximal the front half right edge from the front half top edge to proximal the front half bottom edge, and the left slot is continuously disposed on the front surface of the clasp front half proximal the front half left edge from the front half top edge to proximal the front half bottom edge;

a plurality of interchangeable decorative covers, each of the plurality of decorative covers having a right side and a left side, wherein a right side and a left side of one of the plurality of decorative covers removably and slidably engages within the right slot and the left slot, respectively;

wherein a perimeter of each of the plurality of decorative covers substantially conforms to a perimeter of the clasp front half.

3. The fabric gathering device of claim 2 wherein the clasp and each of the plurality of decorative covers are substantially rectangular.

4. The fabric gathering device of claim 3 wherein the clasp has a length within a range of one inch to ten inches.

5. The fabric gathering device of claim 4 wherein the clasp has a width within a range of one inch to ten inches.

6. The fabric gathering device of claim 5 wherein the clasp and each of the plurality of decorative covers is metal.

7. The fabric gathering device of claim 5 wherein the clasp and each of the plurality of decorative covers is plastic.

* * * * *